US007614927B2

(12) United States Patent
Olsen et al.

(10) Patent No.: US 7,614,927 B2
(45) Date of Patent: Nov. 10, 2009

(54) DEVICE FOR LOADING AND/OR UNLOADING FLOWABLE MEDIA

(75) Inventors: Bjarne Olsen, Oslo (NO); Petter Grinde, Ås (NO); Tron Dahl, Nordre Frogn (NO); Ola Often, Stabekk (NO)

(73) Assignees: Scana AMT AS, Vestby (NO); FPS Ocean AS, Oslo (NO)

( * ) Notice: Subject to any disclaimer, the term of this patent is extended or adjusted under 35 U.S.C. 154(b) by 0 days.

(21) Appl. No.: 11/705,771

(22) Filed: Feb. 14, 2007

(65) Prior Publication Data

US 2007/0202758 A1 Aug. 30, 2007

(30) Foreign Application Priority Data

Jan. 15, 2007 (NO) ..... 20070266

(51) Int. Cl.
*B63B 22/02* (2006.01)

(52) U.S. Cl. ..... 441/5

(58) Field of Classification Search ..... 441/3–5; 166/352–355

See application file for complete search history.

(56) References Cited

U.S. PATENT DOCUMENTS

| | | | | |
|---|---|---|---|---|
| 4,448,568 | A | 5/1984 | Gentry et al. | |
| 4,490,121 | A | 12/1984 | Coppens et al. | |
| 4,547,163 | A | 10/1985 | Langpaap et al. | |
| 4,604,961 | A | 8/1986 | Ortloff et al. | |
| 4,637,335 | A | 1/1987 | Pollack | |
| 4,820,217 | A | 4/1989 | Joubert et al. | |
| 4,892,495 | A * | 1/1990 | Svensen | 441/5 |
| 5,305,703 | A * | 4/1994 | Korsgaard | 441/4 |
| 5,419,398 | A | 5/1995 | Askestad | |
| 5,468,166 | A * | 11/1995 | Breivik et al. | 441/5 |
| 5,941,746 | A * | 8/1999 | Isnard et al. | 441/4 |
| 6,050,747 | A * | 4/2000 | Midttveit | 405/224.2 |
| 6,736,082 | B2 * | 5/2004 | Breivik et al. | 114/230.1 |

FOREIGN PATENT DOCUMENTS

| | | |
|---|---|---|
| GB | 2 050 995 A | 1/1981 |
| GB | 2 387 188 A | 10/2003 |
| WO | WO-87/05876 A1 | 10/1987 |
| WO | WO 93/11030 | 6/1993 |
| WO | WO 93/11031 | 6/1993 |
| WO | WO 93/11032 | 6/1993 |
| WO | WO 93/11033 | 6/1993 |
| WO | WO 93/11034 | 6/1993 |

(Continued)

*Primary Examiner*—Ed Swinehart
(74) *Attorney, Agent, or Firm*—Birch, Stewart, Kolasch & Birch, LLP

(57) ABSTRACT

A device for loading and/or unloading of flowable media includes a buoy connected to at least one riser and a vessel provided with a pick-up space for the buoy. The pick-up space ends at the bottom of the vessel, the buoy being provided with a buoyancy device and including a first part connected to the at least one riser and a second part which can be rotated with respect to the first part. The second part is arranged for locking to the vessel. The buoy comprises a connected for connecting the at least one riser to a swivel for transfer of the flowable medium. When the vessel is connected to the buoy, its position is maintained by a dynamic positioning system.

17 Claims, 12 Drawing Sheets

FOREIGN PATENT DOCUMENTS

| | | | |
|---|---|---|---|
| WO | WO 93/11035 | | 6/1993 |
| WO | WO 93/18962 | | 9/1993 |
| WO | WO 93/24732 | | 12/1993 |
| WO | WO-98/36964 | A1 | 8/1998 |
| WO | WO-2006/044053 | A1 | 4/2006 |

* cited by examiner

DEVICE FOR LOADING AND/OR UNLOADING FLOWABLE MEDIA

BACKGROUND OF THE INVENTION (1) Field of the Invention

The present invention regards a loading buoy for loading and unloading liquids and gases in open sea.

(2) Description of Related Art

Several buoys of this type are known. The prior art buoys support one end of one or more risers that extend from storage tanks on the seabed, e.g. at a nearby production facility. The buoy is moored to the seabed and floats a distance below the surface of the sea, due to a positive buoyancy. When used for loading or unloading, the buoy is pulled up into a pick-up space in a vessel and held there. A swivel connected to loading and unloading lines aboard the vessel is coupled to the top of the buoy and connected to the tops of the risers from the buoy. Loading or unloading can then commence.

The buoy comprises an outer and an inner part which are interrotatable, the outer part being kept rotationally fixed relative to the vessel, and the inner part being substantially rotationally fixed relative to the seabed, by way of the mooring. Thus the vessel can rotate under the influence of wind and current without affecting the loading or unloading process.

A common feature of known solutions such as described in inter alia U.S. Pat. Nos. 4,490,121, 4,604,961, NO 176 131, NO 175 419, NO 175 420 and NO 175 421 is that of the buoy being moored to the seabed. Mooring the buoy may seem natural, as it is desired that the buoy stay substantially stationary. The mooring also serves as mooring for the vessel when connected to the buoy. This allows the vessel to weather a storm without there being any risk of it coming adrift and without wind and current affecting the loading and unloading operation.

However, mooring the buoy also carries drawbacks. The mooring requires the buoy to absorb all the forces exerted by the mooring line. These forces can get very large when there are heavy currents affecting a moored vessel. Consequently the buoy must be dimensioned to take up these forces. Heavy dimensioning means a high steel weight. A high steel weight requires the buoy to have a relatively large buoyancy chamber in order to float at the correct depth. This means that the buoy will be quite large. A large buoy requires a large pick-up space in the vessel. A large pick-up space has implications for the support structure of the vessel and therefore can not be placed just anywhere in the vessel. Thus the pick-up space has been located at the bow, which is already built to take up large stresses and strains.

However, all the above factors will impose certain limitations on the design of both the buoy and the vessel. The present invention aims to eliminate or at least bring about a substantial reduction in these limitations.

BRIEF SUMMARY OF THE INVENTION

This invention goes to the extreme measure of completely removing the mooring of the buoy to the seabed, thus leaving the buoy to be suspended from the risers only. Eliminating the need for the buoy to take up mooring forces allows it to be dimensioned only to support the risers. In turn, the risers are not subjected to any significant stress from the buoy, due to the small size and weight of this.

Thus the invention provides a light buoy of relatively small dimensions.

According to the invention there is provided a device for loading and/or unloading of flowable media, comprising a buoy which is connected to at least one riser and a vessel provided with a pick-up space for the buoy, which space ends at the bottom of the vessel, the buoy being equipped with buoyancy means and comprising a first part connected to the at least one riser and a second part which is interrotatable with the first part, the second part being arranged for locking to the vessel, the buoy comprising coupling means for coupling the at least one riser to a swivel for transfer of the flowable medium. The invention is characterized in that, when connected to the buoy, the vessel is kept in position by a dynamic positioning system.

As the buoy of the invention can not be used to moor the vessel to the seabed, other means must be employed to keep the vessel at the correct position. This is achieved by use of so-called dynamic positioning (DP). DP has been used since 1960 to position floating facilities, e.g. for oil and gas production.

In a DP system, a navigational system such as GPS is connected to a controller that monitors deviations in vessel position from the desired position. The controller is further connected to several thrusters. The thrusters return the vessel to the desired position if the deviation exceeds a certain value, and will also maintain a correct orientation of the vessel relative to wind and current.

With the dimensions of the buoy being smaller than for existing buoys, the dimensions of the pick-up space in the vessel can also be reduced significantly. Due to the reduced weight of the buoy, the buoy support arrangements onboard the vessel can also made much simpler. This saves space onboard the vessel and means that the pick-up space can be located where most appropriate, e.g. amidships.

In a preferred embodiment the first part of the buoy comprises most of the buoyancy means and is of a considerably larger volume than the second part of the buoy. Thus the buoyancy is provided by another part than that which is to be attached to the vessel. This means that the part which is to be attached to the vessel can be relatively small, and its support can be made simpler.

Connecting the buoy according to a preferred embodiment with the seabed via only the at least one riser will completely avoid mooring of the buoy.

Arranging the upper part of the buoy to be kept dry in the pick-up space allows easy access for inspection and repairs without taking any special measures.

Securing the buoy to the vessel by means of only a downward facing shoulder allows the devices that hold the buoy to be of a simple design, and makes it possible to disconnect the buoy in a short time. Moreover, it simplifies the support of the part of the buoy which is attached to the vessel.

A substantially cylindrical moon pool with a supporting structure makes it possible to alter existing vessels without excessive interventions.

Having the moon pool open at the top and bottom allows for easy access for installation and maintenance.

Active rotation of the buoy with the means of active rotation connected to the directional control of the vessel makes it easy to maintain the geostationary part of the buoy at the correct orientation.

Arranging the pick-up space close to the centre of motion of the vessel avoids large movements in the buoy.

Arranging the buoy hanging deck close to the neutral axis of the vessel places it at the location of the lowest stress concentrations.

In a preferred embodiment the device comprises a buoy pick-up tool which comprises a shield arranged for placement over the upper end of the buoy, and which is provided with a guide funnel for a gripper. This allows safe gripping of the buoy without risk of damage.

A significant share of the weight of the buoy is carried by its buoyancy, thus reducing the strain on the locking arms securing it to the vessel.

The buoy comprises means of adjusting its buoyancy by charging it with air or water after the buoy has docked in the vessel, thus making it easy to adjust the buoyancy of the buoy to the weight which the buoy is to support.

The buoyancy tanks can be ballasted individually, allowing the buoyancy of the buoy to be adjusted relative to risers and variations in weight, fouling and stability, and thus the ballasting of the buoy can be optimized.

The buoy comprises a central buoyancy chamber and peripheral ballasting chambers, thus allowing optimization of the weight distribution.

Gathering the connections to all the risers in a multibore connector makes for quick and easy connection and disconnection.

Providing the device with means of flushing out the connector in the case of an emergency disconnect avoids discharges of pollutants.

All hydraulic operations in the moon pool are carried out from the deck of the vessel, and no electric or hydraulic control systems are required in the moon pool. This means that EX requirements are met without any special measures being introduced.

Descriptive terms hereinafter, such as lower and upper parts and similar terms, as applied to among other things the buoy and the pick-up space, refer to the orientation of these elements in the operative mode.

BRIEF DESCRIPTION OF THE SEVERAL VIEWS OF THE DRAWING(S)

The invention will now be explained in greater detail by means of an exemplary embodiment illustrated in the accompanying drawings, in which.

DETAILED DESCRIPTION OF THE INVENTION

Figure 1:
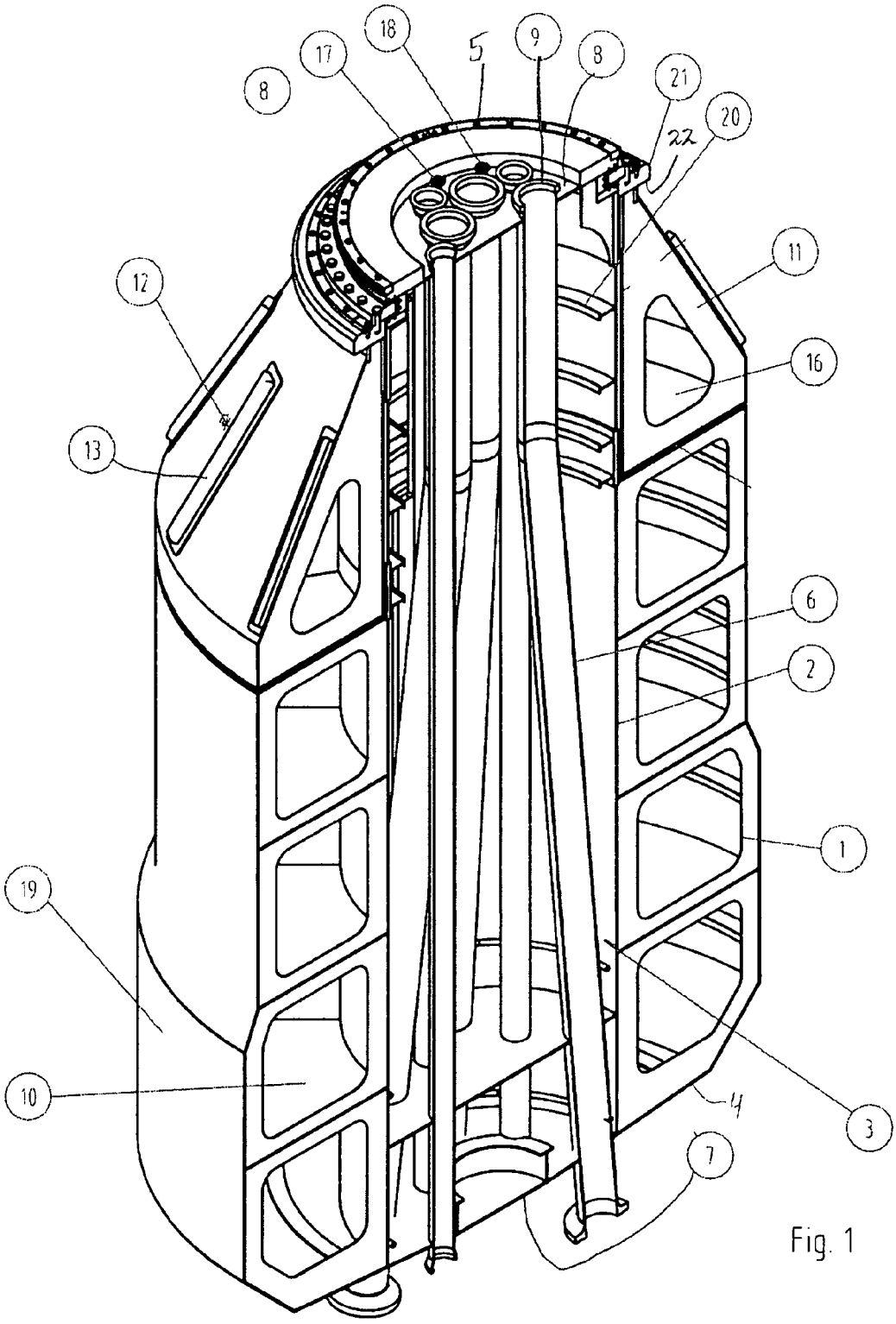
FIG. 1 is a sectional and perspective view of a currently preferred embodiment of a buoy according to the invention.
Figure 2:
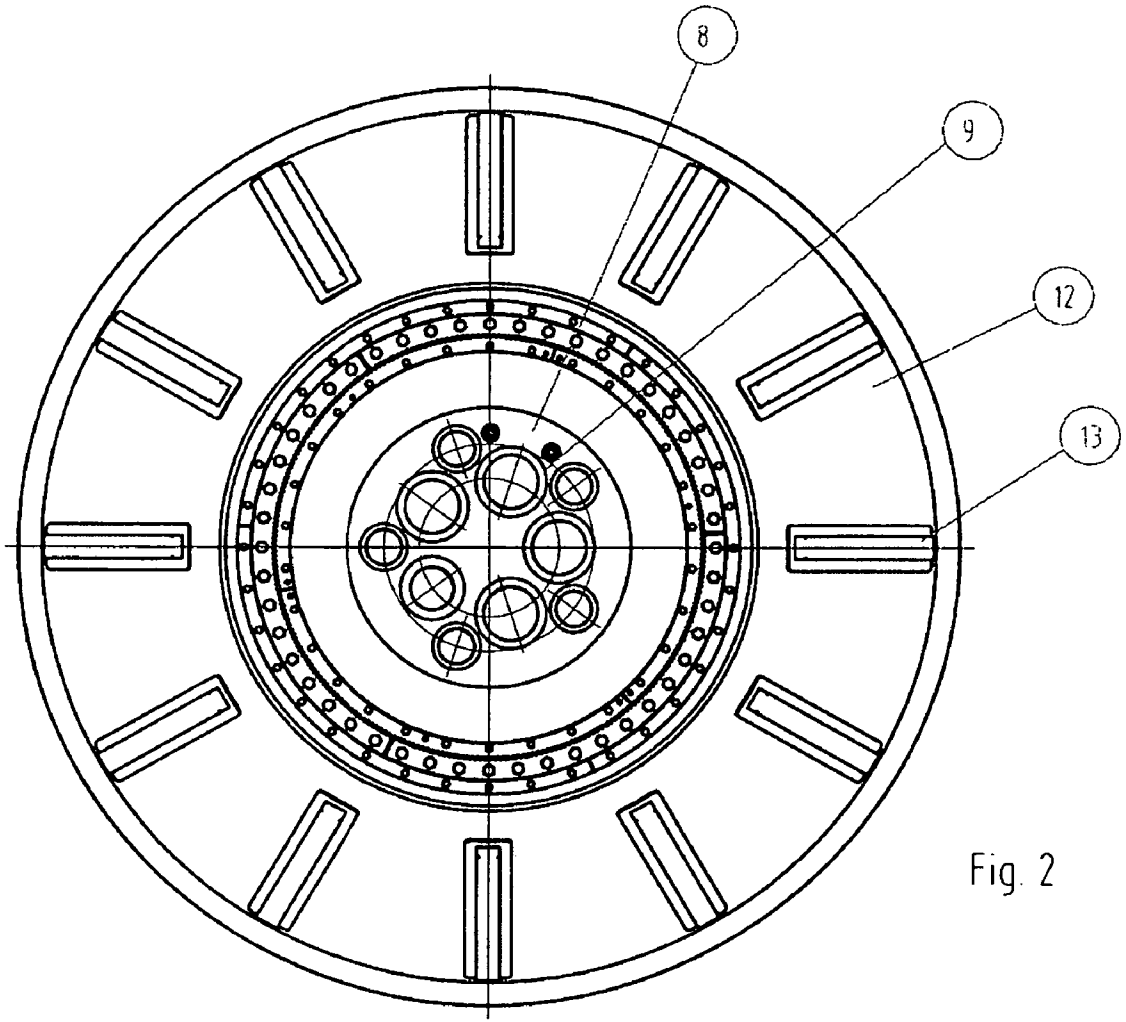
FIG. 2 is a top view of the buoy of FIG. 1.
Figure 3:
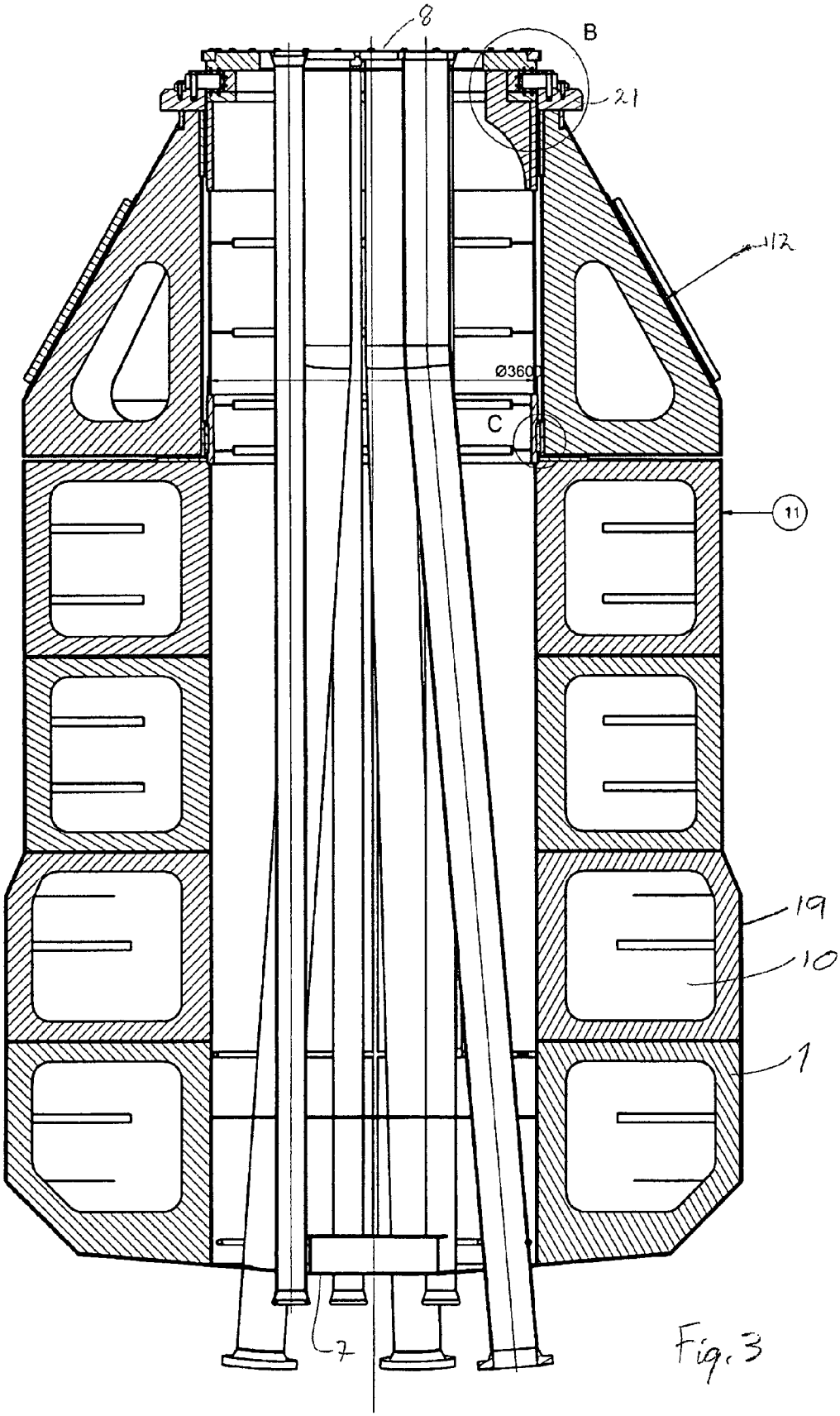
FIG. 3 is a sectional view of the buoy of FIG. 1.

Reference is first made to FIGS. 1, 2 and 3. In FIG. 1, the buoy is shown generally to comprise a lower buoyancy part 1 and an upper fixation part 11. A central tube 2 extends through these, defining an inner cavity 3. Through the inner cavity there extend several risers 6 which are connected to a transport line on the seabed. These risers 6 are held by a lower cover 7 and an upper cover 8 at the lower 4 and upper 5 ends of the buoy, respectively. The covers 7, 8 also serve to seal the cavity 3 against the seawater. Thus the cavity 3 can function as a buoyancy chamber. Optionally the cavity 3 can be filled with seawater. The cover 8 is provided with a water inlet/outlet 17 and an air inlet/outlet 18 to allow water and air to be pumped in.

The upper ends of the risers are provided with connecting pieces 9. Shutoff valves (not shown), preferably automatic ones, are also provided here.

The buoyancy part 1 comprises several ballast chambers 10 which can be filled with air or water to adjust the buoyancy. These chambers 10 can also be connected to the inlets/outlets 17, 18. The diameter of the buoyancy part is slightly larger at the lower end 19. The purpose of this will be explained in detail below.

The upper fixation part has a frusto-conical shape with a conical face 12. On this face there are provided impact elements 13 shaped as strips of a rubber material or another shock absorbing material. The fixation part 11 is rotatably arranged on the central tube 2, and a slide bearing system is provided between the fixation part 11 and the central tube 2, to be explained in more detail below.

The fixation part 11 may also include ballast chambers 16; however, these will be of a much smaller size than the ballast chambers 10 in the buoyancy part 1.

The portion of central tube 2 extending through the fixation part 11 carries internal reinforcing ribs 20.

At the upper end of the fixation part 11 there is provided a locking ring 21. This has a downward facing shoulder 22 encircling the ring 21. The locking ring 21 is used to lock the fixation part 11 to the vessel, as will be described hereinafter.

Figure 4:
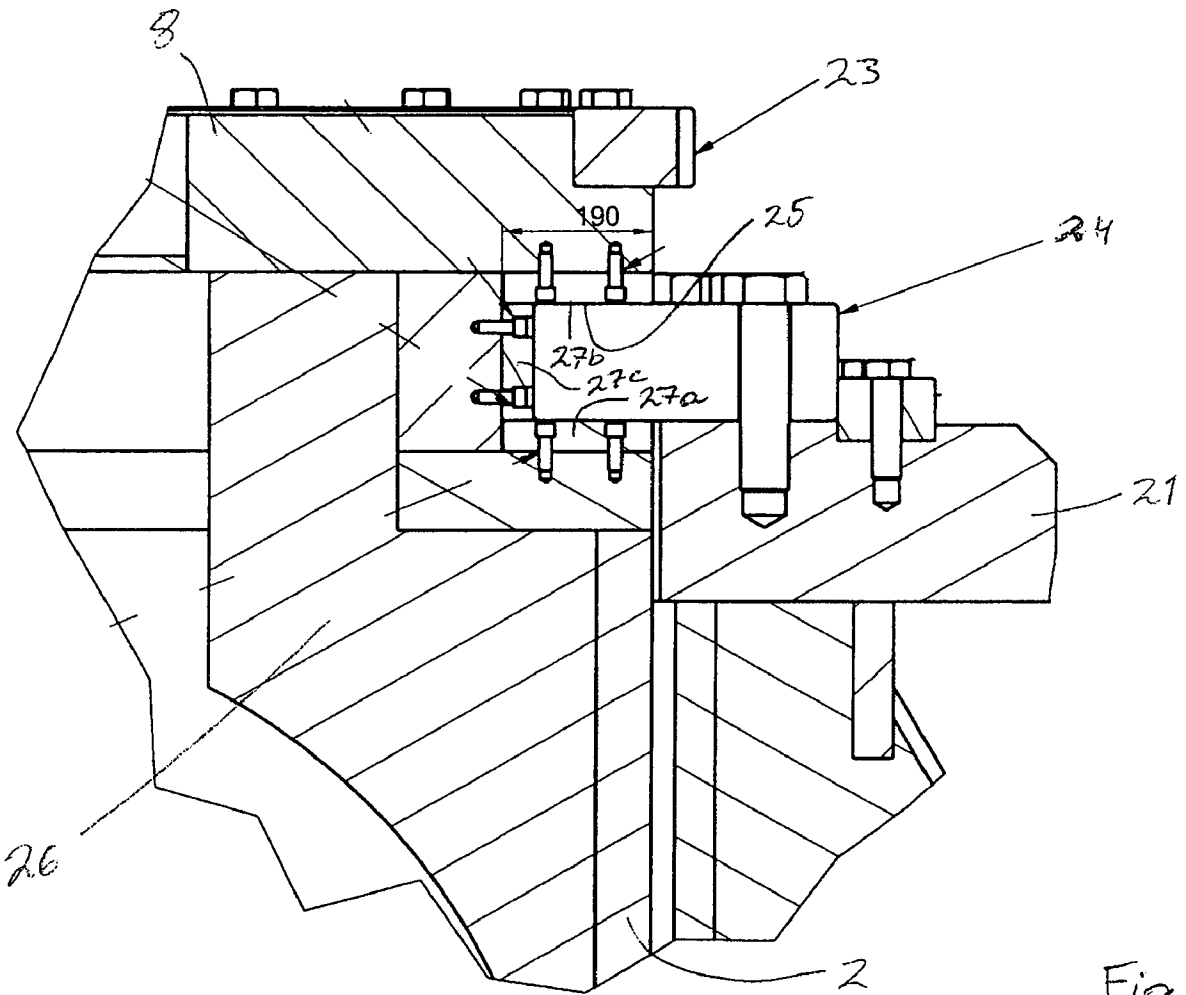
FIG. 4 shows a section B of the buoy of FIG. 3.

As can best be seen in FIG. 4, which shows a section B of FIG. 3, the locking ring 21 is provided with a guide/retaining ring 24 projecting into a groove 25 formed in a reinforced portion 26 which forms the connection between the central tube 2 and the cover 8. Between the guide/retaining ring 24 and the groove 25 there is a slide bearing system 27 consisting of a lower thrust bearing 27*a*, an upper thrust bearing 27*b* and an upper radial bearing 27*c*. The periphery of the cover 8 has a gear rim 23. The function of this gear rim 23 will be explained in more detail below.

Figure 5:
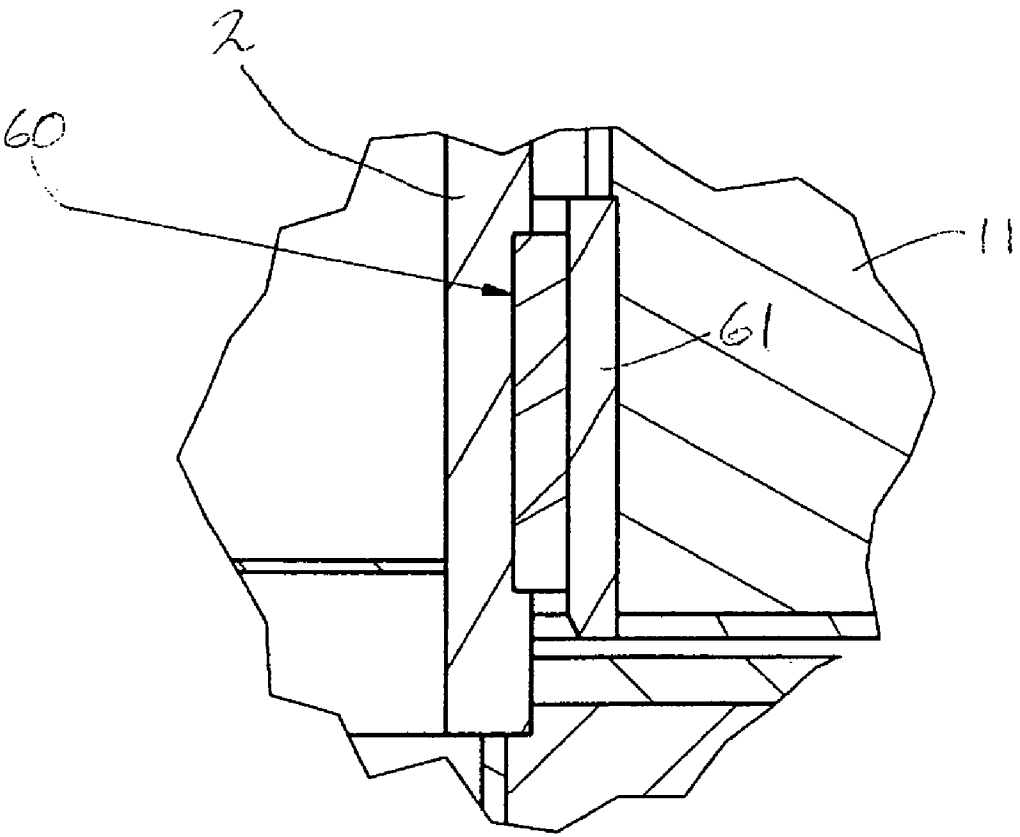
FIG. 5 shows a section C of the buoy of FIG. 3.

FIG. 5 shows a section C at the lower end of the fixation part 11, where it borders on the central tube 2. Here is provided a lower thrust bearing in the form of a sliding ring 60 attached to the central tube 2 and a sliding ring 61 attached to the fixation part 11. This area of the central tube 2 comprises a reinforced section.

Figure 6:
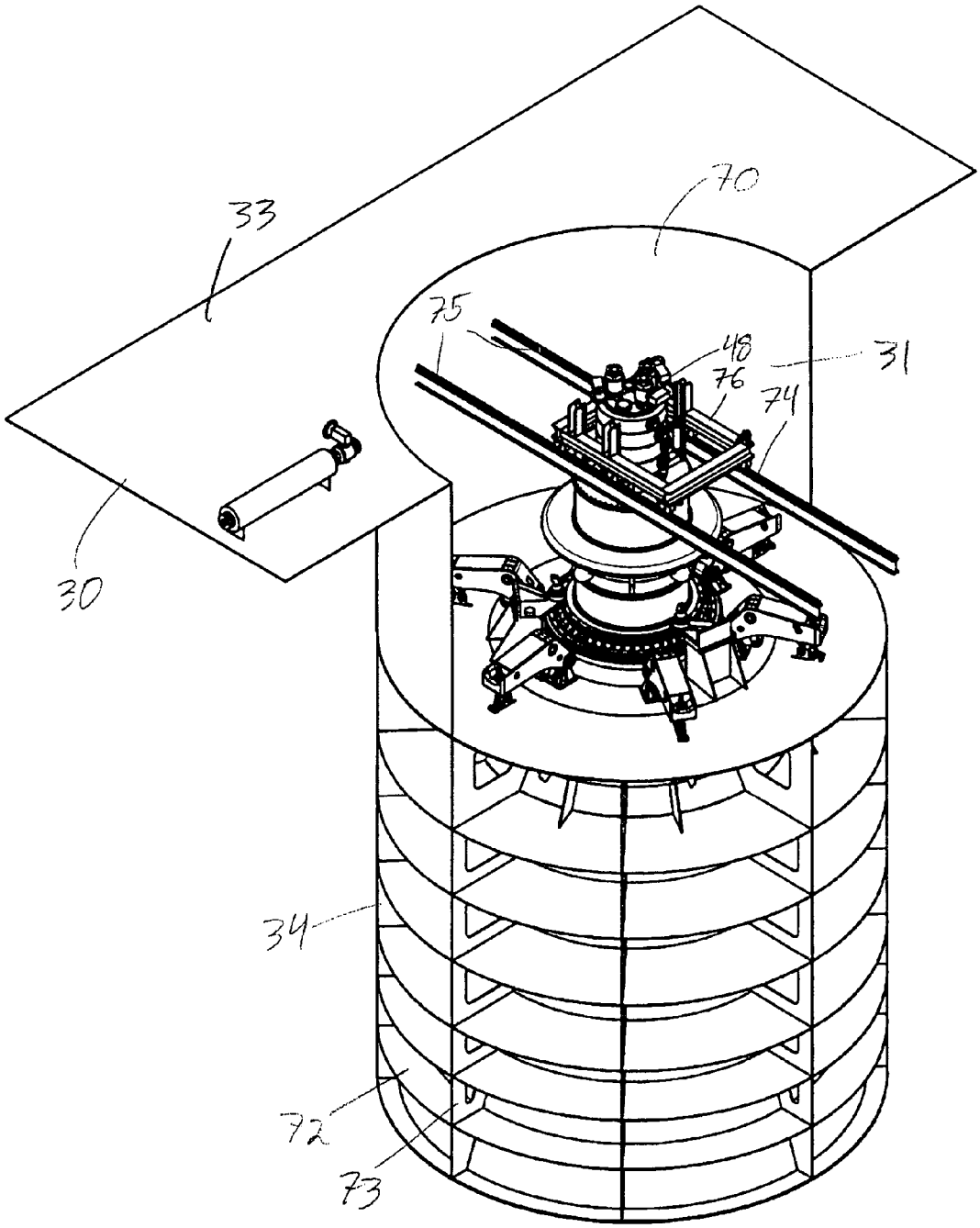
FIG. 6 is a perspective view of a section of a vessel connected to a buoy according to the invention.

FIG. 6 shows a section of a vessel 30 with a deck 33. A circular opening 70 defines the upper end of the moon pool 31. Inside the moon pool 31 there is provided a structure 34 constructed from tray rings 72 and braces 73, and the inside of which defines a pick-up space 77. The structure 34 has an upper face 35 which also serves as a hanging deck, on which there is provided a system of locking arms which is to be used to secure the buoy to the structure 34. These locking arms 36 are known per se, and thus will not be explained in greater detail herein.

In the moon pool 31 there is also provided a system 74 of rails to hold a swivel 48. The system 74 of rails generally consists of a pair of rails 75 and a carriage 76 which can be moved along the rails 75. The carriage is provided with hydraulic actuators (not shown) arranged to raise and lower the swivel.

Figure 7:
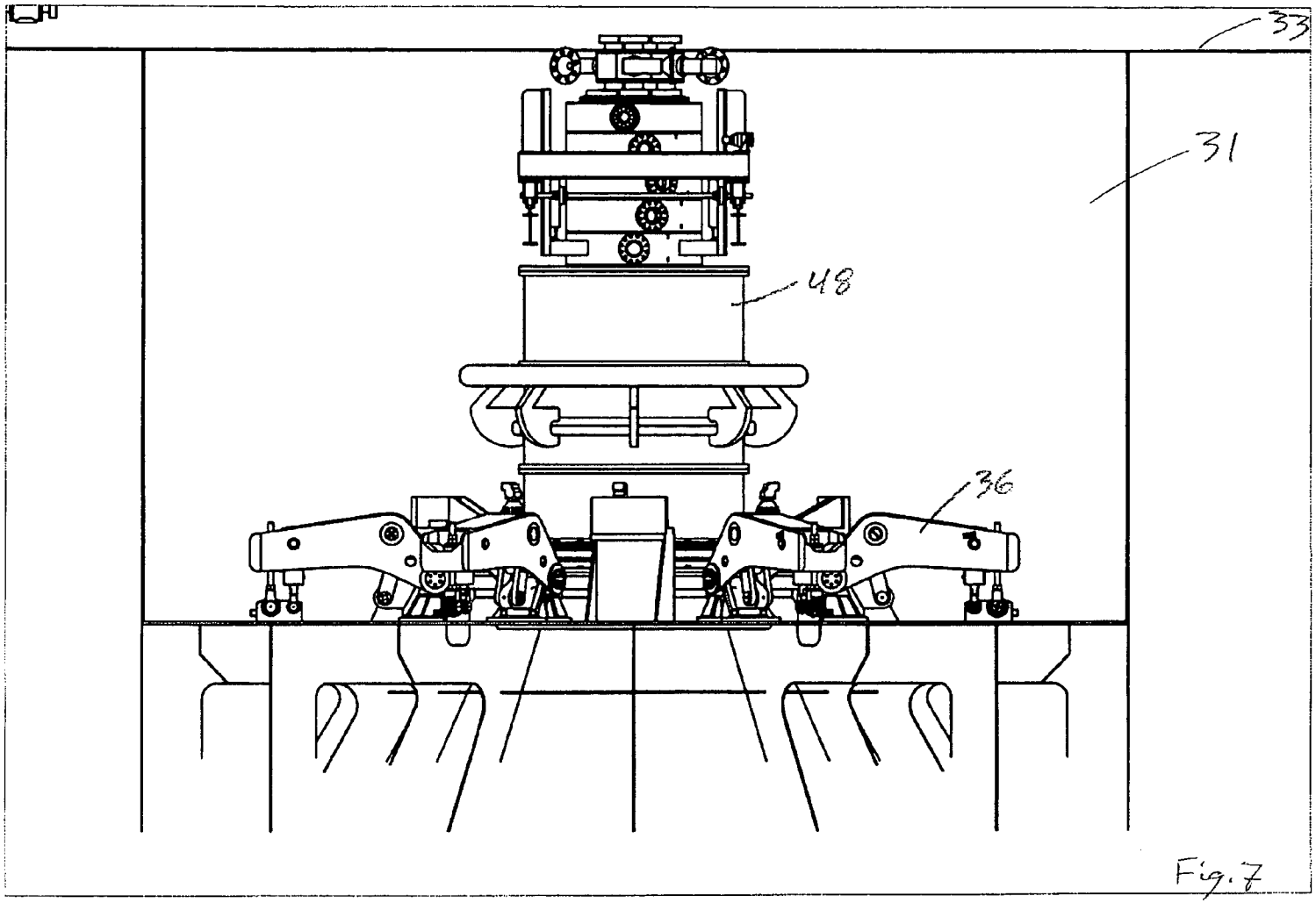
FIG. 7 shows a section of the vessel and the upper part of the buoy according to the invention.

FIG. 7 is a side view of the upper part of the structure 34 and the swivel 48.

Figure 8:
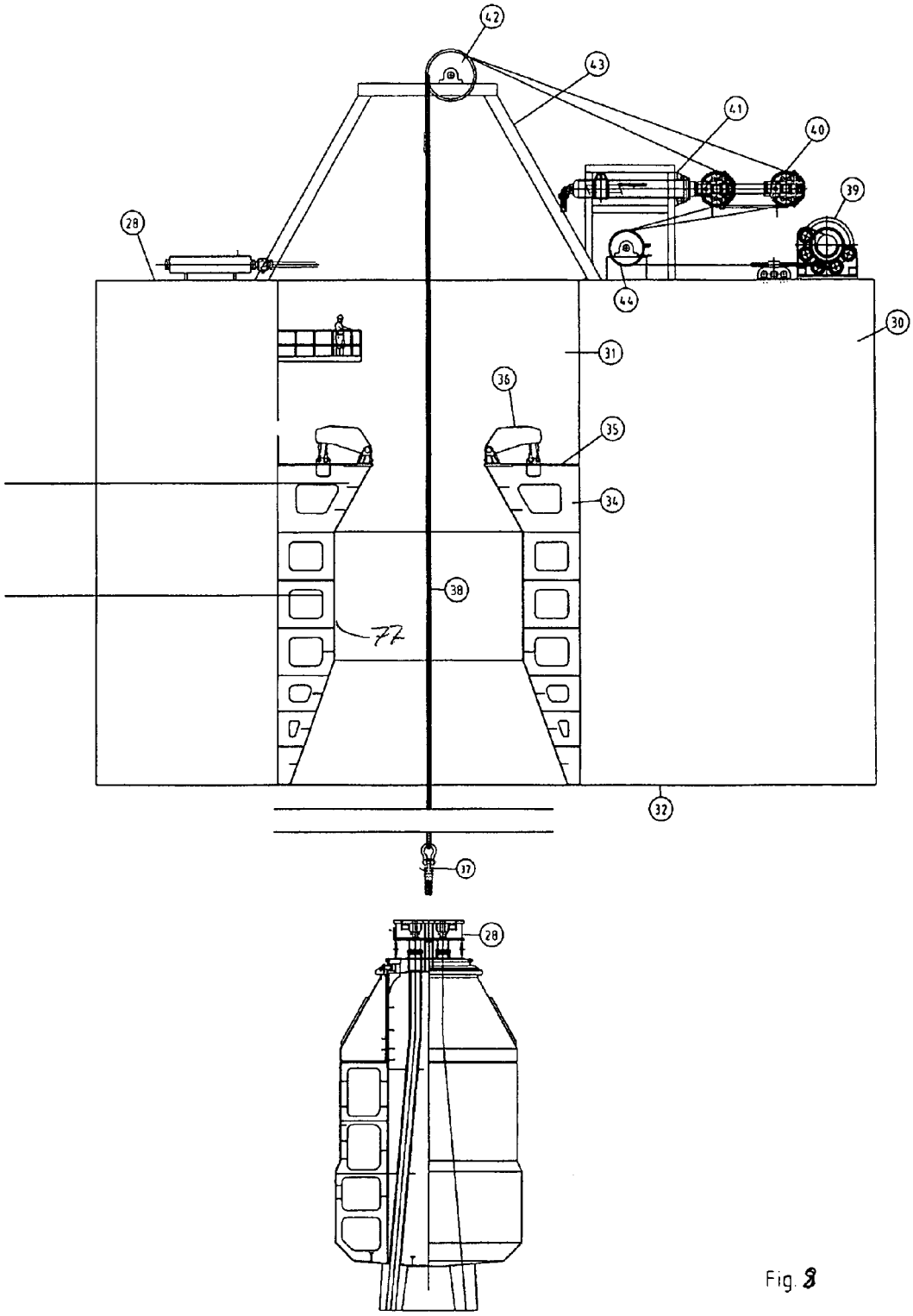
FIG. 8 shows the buoy and a part of a vessel just before the buoy is to be picked up into the vessel.

Reference is now made to FIG. 8, where the buoy of FIG. 1 is shown schematically, floating under the surface of the sea. Here, the buoy is equipped with a coupling member 28 comprising among other things a shoulder for landing the swivel 48. The coupling member is a multibore connector which allows all the risers 6 to be connected to the swivel 48 through one connection. A vessel 30 is positioned over the buoy. This positioning is primarily achieved by means of a navigational system such as GPS, where the initial position of the buoy is known. Once the vessel has reached this position, a transponder system will be activated to allow the exact position of the buoy to be determined.

As previously mentioned, the vessel 30 includes a moon pool 31. Preferably this extends from the bottom 32 of the vessel to the deck 33, but it is possible to construct the moon pool only in the lower part of the vessel.

As previously mentioned, a structure 34 is provided in the moon pool 31, the inside shape of which is largely complementary to the outside shape of the buoy.

A gripper 37 is lowered to bring the buoy up into the pick-up space 31. This gripper may be a gripper of the Ballgrab® type, which is marketed by BSW Ltd. The gripper 37 is suspended from a wire 38 which is controlled by a winch 39. The wire passes via a reversing pulley 44 and over a pulley 40 which is connected to a hydraulic heave compensator 41. The wire 38 then passes over a pulley 42 arranged in a rack over the pick-up space 31.

On the gripper there is provided a transponder which emits signals that a transponder on the buoy responds to. This allows the exact position of the buoy to be determined. The gripper may also be provided with a camera to allow the final alignment and guiding of the gripper into the buoy receiving port to be performed visually. Optionally, the connection can be made using only visual control.

A cover (not shown) may be lowered before or possibly simultaneously with the gripper and be placed over the coupling member 28 to ensure that the gripper contacts the buoy in the correct manner and to prevent it from causing damage to the buoy or the coupling member 28. The cover is provided with a conical funnel which, upon correct placement of the cover, guides the gripper down into the correct receiving port.

Figure 9:
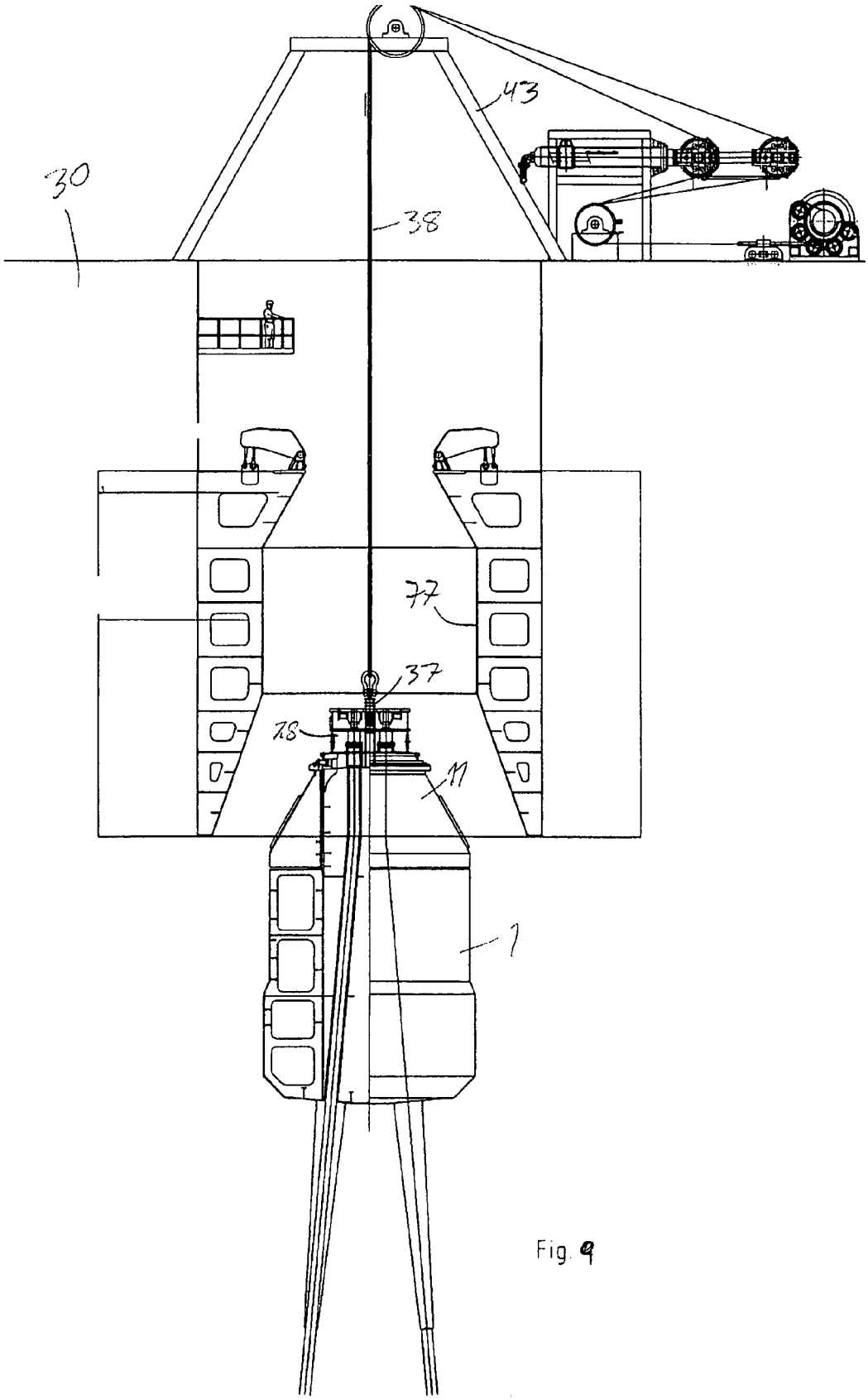
FIG. 9 shows the buoy being hoisted up into the pick-up space in the vessel

When the gripper 37 has been connected to the buoy, the buoy may be hoisted up. FIG. 9 shows the buoy about to be hoisted into the pick-up space. In the course of this hoisting the risers that extend to the seabed, and which are normally curved or S-shaped, will straighten out slightly. The risers are sufficiently flexible that this straightening and a certain amount of drift in the vessel or the buoy will be of no consequence.

Figure 10:
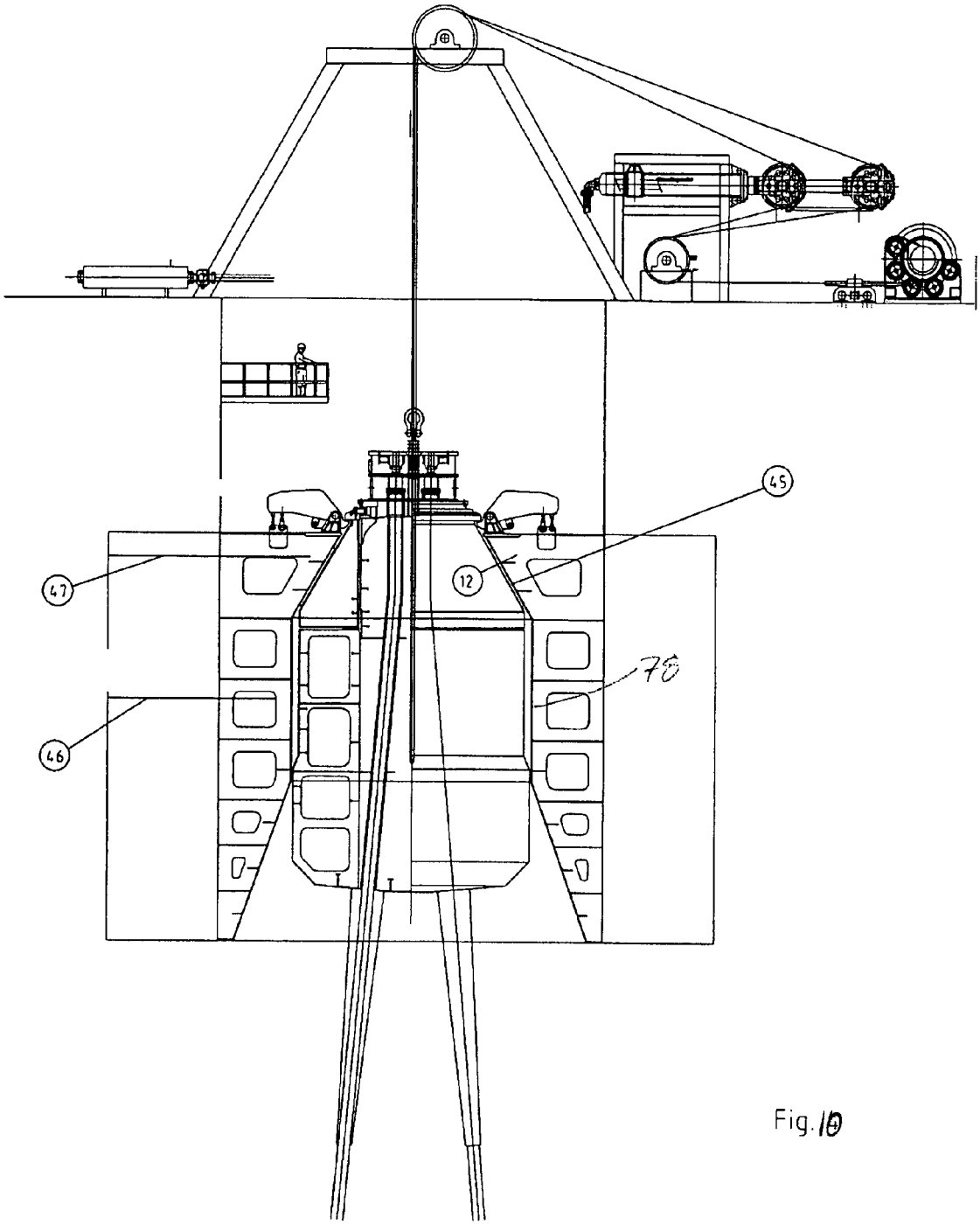
FIG. 10 shows the buoy after it has been hoisted all the way into the pick-up space.

In FIG. 10 the buoy has come all the way into the pick-up space, and the conical face 12 of the fixation part 11, with the impact elements 13, abuts a downward facing complementary face 45 on the structure 34. Here, the buoy is locked into place by guiding the locking arms 36 into the groove 22 in the locking ring 21.

In this position, the upper end of the buoy is above the surface of the sea. The water surface will be between a lower level 46 and an upper level 47, depending the vessel loading. Thus the connecting pieces 9 for the risers 6 and the locking ring 21 are dry, making it easy to inspect and repair these parts. It is also quite easy to connect up air and water hoses to the inlet/outlet 17, 18 of the buoy, for adjusting the buoyancy of the buoy. Sealing elements (not shown) are provided on the buoy or on the walls of the pick-up space 77 to avoid seawater splashing up between the buoy and the walls of the pick-up space 77.

The buoy is suspended only from the locking ring 21. However, the outer diameter of the lower portion 19 of the buoy is matched to the diameter of the pick-up space, forming a lower point of support at an overlap area between the lower portion 19 of the buoy and a cylindrical part 78 of the pick-up space 77. The clearance between the rest of the buoy and the cylindrical portion 78 of the pick-up space 77 is designed such that fouling on the buoy will be scraped off to a certain extent when the buoyancy part 1 of the buoy rotates in the pick-up space 77, but also such that the buoy will move easily into the pick-up space.

Figure 11:
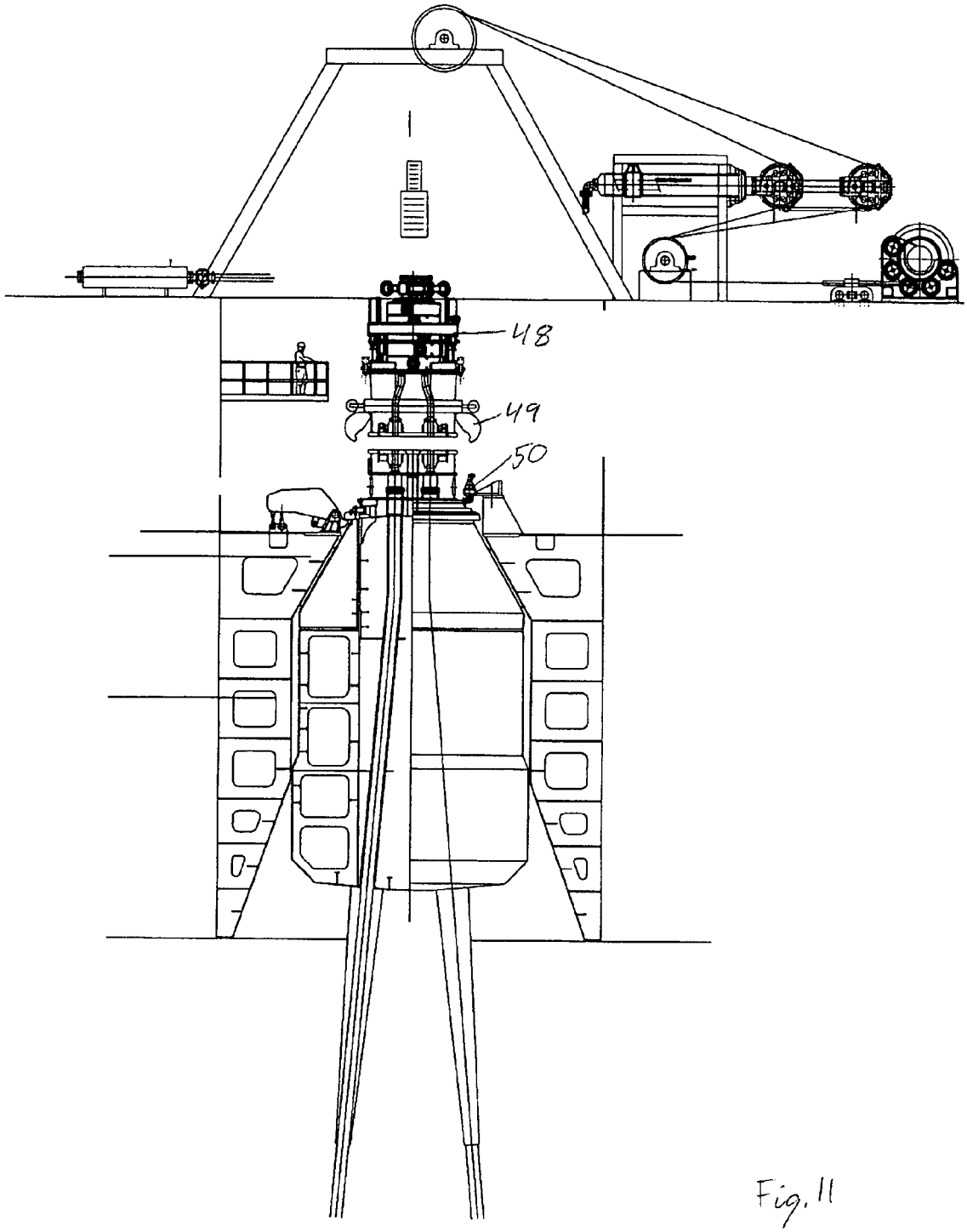
FIG. 11 shows the buoy locked in place in the pick-up space and about to be connected to a swivel.

When the buoy is locked to the structure 34 the gripper 37 may be released. A swivel 48 is connected up in its place, as shown in FIG. 11. The swivel is guided onto the rails 75 and lowered onto the coupling member 28 by means of hydraulic actuators. One or more loading/unloading lines (not shown) are connected to the swivel 48. The swivel 48 is attached to the upper part of the buoy by a system of gripping arms 49 which are arranged to grip around a shoulder on the buoy coupling member 28. The swivel generally consists of two parts, a lower part which is stationary relative to the buoy coupling member 28 and an upper part which is stationary relative to the vessel. The construction of such swivels is generally known to a person of skill and will not be explained in greater detail herein. However, in this particular case the buoy coupling member 28 and the swivel 48 are multibore, allowing all the risers 6 to be connected to the swivel 48 and the loading/unloading lines on the vessel 30 through one connection. Both the swivel 48 and the coupling member 28 are provided with valves that can be closed automatically to allow a quick disconnect in an emergency.

In addition to the swivel 48, a plurality of (preferably three) rotary motors 50 are also brought into engagement with the gear rim 23 on the buoy. These motors 50, which are rigidly mounted to the vessel 30, will actively rotate the buoyancy part 1 of the buoy relative to the fixation part 11, in dependence on the rotation of the vessel. The rotation of the vessel may be detected by means of GPS. This avoids twisting of the risers extending to the seabed.

Figure 12:
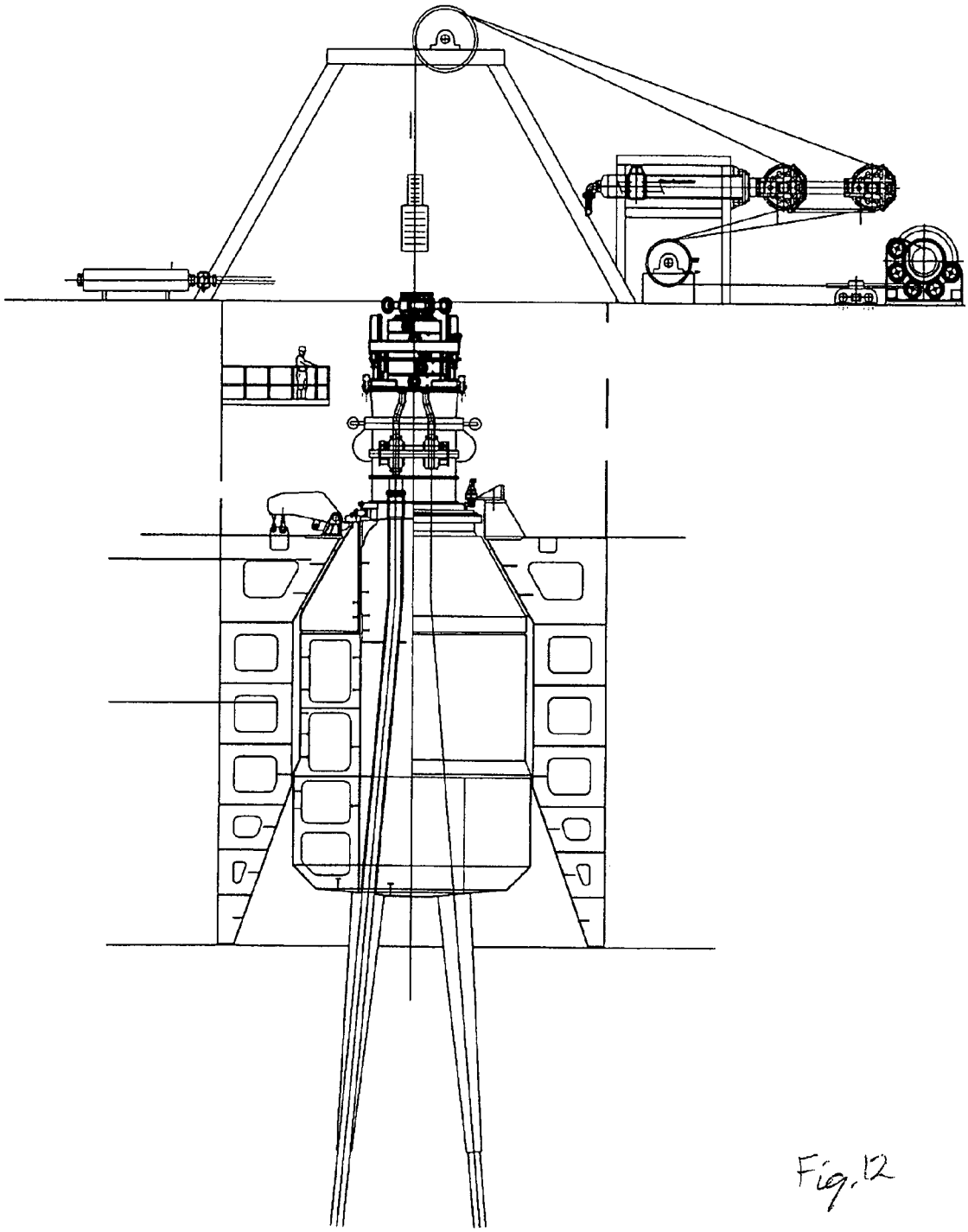
FIG. 12 shows the buoy connected up and ready for the loading/unloading operation.

In FIG. 12 the swivel 48 is coupled to the buoy coupling member 28 and is ready for loading or unloading.

The present buoy allows retrofitting of more risers as the oil/gas field is developed. New risers may be pulled into the buoy while it is connected to the vessel 30.

If an emergency situation arises when loading or unloading via the buoy, where the situation demands that the vessel must quickly leave the buoy, the device of the present invention makes it possible to perform a controlled disconnect in about a minute. As the swivel is connected to the buoy via a multibore connector and the coupling is held in place by a set of co-operating gripping arms 49, this coupling can be released in a matter of seconds. Both the swivel 48 and the buoy coupling member 28 are equipped with isolating valves that will close immediately in the case of a rapid drop in pressure. Once the valves have closed it is possible to flush out the connector 28 to prevent any oil being discharged into the sea. The washwater can be collected by collecting means on the face 35. After that the locking arms 36 release the buoy, which quickly falls into the sea.

A clump weight is suspended from the buoy in a rope, so as to make the buoy sink quickly but without subjecting the buoy to excessive strain after reaching the desired immersion depth. As long as the clump weight is above the seabed it will exert a force on the buoy. This force or weight will cause the buoy to sink rapidly away from the vessel. When the clump weight reaches the seabed this weight will be relieved and the buoy is kept floating by the carefully ballasted buoyancy.

When releasing the buoy in the normal manner, a cover will be installed over the coupling member 28 following the disconnection of the swivel 48, to protect it against damage and fouling.

The invention claimed is:

1. A device for loading and/or unloading of flowable media, comprising a buoy connected to at least one riser and a vessel equipped with a dynamic positioning system and means to rotate a portion of the buoy and a pick-up space for the buoy, which pick-up space ends at the bottom of the vessel and includes at least one dry portion and receiving means to hold the buoy in a fixed position in the pick-up space, the buoy being provided with buoyancy means and comprising a first part connected to the at least one riser and a second part which can rotate with respect to the first part, the second part being arranged for locking to the vessel, wherein the buoy comprises connecting means for connecting the at least one riser to a swivel for transfer of flowable media, characterized in that the receiving means are arranged in the dry portion of the pick-up space which is located above water line of the vessel and are adapted to engage the second part of the buoy when the second part of the buoy is arranged in the dry portion of the pick-up space, and wherein the first part of the buoy is actively rotated by the means to rotate a portion of the buoy, the means to rotate a portion of the buoy being associated with the dynamic positioning system of the vessel.

2. A device in accordance with claim 1, characterized in that the first part of the buoy comprises most of the buoyancy means of the buoy and is of a significantly larger volume than the second part of the buoy.

3. A device in accordance with claim 1, characterized in that the buoy is connected to the seabed only via the at least one riser.

4. A device in accordance with claim 1, characterized in that the vessel comprises a generally cylindrical moon pool with a support structure.

5. A device in accordance with claim 4, characterized in that the moon pool is open both at the top and the bottom.

6. A device in accordance with claim 1, characterized in that the pick-up space is located near a centre of motion of the vessel.

7. A device in accordance with claim 1, further comprising a buoy hanging deck located near a neutral axis of the vessel.

8. A device in accordance with claim 1, characterized in that a material part of the weight of the buoy is supported by the buoyancy of the buoy.

9. A device in accordance with claim 1, characterized in that the buoy is adapted to having its buoyancy adjusted by being filled with air or water after the buoy has docked in the vessel.

10. A device in accordance with claim 1, characterized in that the buoy includes buoyancy tanks which can be ballasted individually to allow the buoyancy of the buoy to be adjusted relative to risers and variations in weight, fouling and stability.

11. A device in accordance with claim 1, characterized in that the buoy comprises a central buoyancy chamber and peripheral ballasting chambers.

12. A device in accordance with claim 1, further comprising a multibore connector for gathering together connections to all the risers in the buoy.

13. A device in accordance with claim 1, characterized in that all hydraulic operations in a moon pool are performed from the vessel deck, and there is no requirement for electric and hydraulic control systems in the moon pool.

14. A device in accordance with claim 2, characterized in that the buoy is connected to the seabed only via the at least one riser.

15. A device in accordance with claim 1, characterized in that shape of the first part of the buoy is substantially cylindrical and the shape of the second part of the buoy is substantially conical.

16. A device in accordance with claim 1, characterized in that the buoy comprises a clump weight connected to the buoy by a line, and wherein the total weight of the buoy, the part of the at least one riser which is above a seabed, and the clump weight, is greater that the buoyancy of the buoy, and that the weight of the buoy alone is less than the weight of the total buoyancy of the buoy and the part of the at least one riser which is above a seabed, at a depth where the clump weight touches the seabed.

17. A buoy for loading and/or unloading of flowable media with respect to a vessel having a dynamic positioning system, directional control and rotation means associated with the vessel directional control to rotate at least a portion of a buoy, the buoy being adapted to be connected to at least one riser and to a vessel equipped with a dynamic positioning system and a pick-up space for the buoy, the pick-up space being located above a bottom of the vessel and including a dry portion, the vessel also being equipped with receiving means located in the pick-up space to hold the buoy in a fixed position in the dry portion of the pick-up space, the buoy being provided with buoyancy means and comprising a first part adapted to be connected to the at least one riser and a second part adapted to rotate with respect to the first part, the second part being adapted for locking to the vessel, and including connecting means for connecting at least one riser to a swivel for transfer of flowable media, wherein the second part of the buoy is adapted to be engaged by the receiving means in the dry portion of the pick-up space which is located above a water line of the vessel, and wherein the first part of the buoy is adapted to be actively rotated by the rotation means.

* * * * *

UNITED STATES PATENT AND TRADEMARK OFFICE

CERTIFICATE OF CORRECTION

PATENT NO. : 7,614,927 B2
APPLICATION NO. : 11/705771
DATED : November 10, 2009
INVENTOR(S) : Bjarne Olsen et al.

It is certified that error appears in the above-identified patent and that said Letters Patent is hereby corrected as shown below:

Title page, Item (73) Assignees, change the names of the Assignees as follows (with the changes being shown in bold):

"Scana AMT AS, Vestby (NO); FPS Ocean AS, Oslo (NO)"

should read

--Scana Offshore Vestby AS, Vestby (NO); FPS Ocean AS, Oslo (NO)--.

Signed and Sealed this

Seventh Day of September, 2010

David J. Kappos

David J. Kappos
*Director of the United States Patent and Trademark Office*